US010239654B2

(12) United States Patent
Choi et al.

(10) Patent No.: US 10,239,654 B2
(45) Date of Patent: Mar. 26, 2019

(54) PACKING BOX

(71) Applicants: YUHA PRINTING & PACKAGING CO., LTD., Cheonan-si, Chungcheongnam-do (KR); Eun Jeong Kim, Seongnam-si, Gyeonggi-do (KR)

(72) Inventors: Jae Hyun Choi, Anseong-si (KR); Beak Jin Kim, Gwangju (KR); Ji Hun Jeong, Cheonan-si (KR); Eun Jeong Kim, Seongnam-si (KR)

(73) Assignee: YUHA PRINTING & PACKAGING CO., LTD., Cheonan-si, Chungcheongnam-Do (KR)

( * ) Notice: Subject to any disclaimer, the term of this patent is extended or adjusted under 35 U.S.C. 154(b) by 138 days.

(21) Appl. No.: 15/388,303

(22) Filed: Dec. 22, 2016

(65) Prior Publication Data

US 2017/0183119 A1 Jun. 29, 2017

(30) Foreign Application Priority Data

Dec. 24, 2015 (KR) ..... 10-2015-0185916
Jul. 13, 2016 (KR) ..... 10-2016-0088390

(51) Int. Cl.
*B65D 5/46* (2006.01)
*B65D 5/10* (2006.01)
*B65D 5/42* (2006.01)

(52) U.S. Cl.
CPC ..... *B65D 5/46088* (2013.01); *B65D 5/10* (2013.01); *B65D 5/4266* (2013.01)

(58) Field of Classification Search
CPC .... B65D 5/46088; B65D 5/4266; B65D 5/10; B65D 5/46096
(Continued)

(56) References Cited

U.S. PATENT DOCUMENTS 1,965,503 A * 7/1934 Lowman ..... B65D 5/0263 206/167
4,171,763 A * 10/1979 Card ..... B65D 5/46088 229/117.15

(Continued)

FOREIGN PATENT DOCUMENTS

JP 40-26781 9/1965
JP 11-139428 5/1999

(Continued)

*Primary Examiner* — Christopher Demeree
(74) *Attorney, Agent, or Firm* — Kile Park Reed & Houtteman PLLC

(57) ABSTRACT

A packing box includes first and second sidewall parts spaced apart and facing each other, first and second connecting parts, a third connecting part attaching the second connecting part to the first sidewall part, a bottom part connecting lower portions of the first and second sidewall parts and the first and second connecting parts, and a top part facing the bottom part and connecting upper portions of the first and second sidewall parts and the first and second connecting parts to form a receiving space. The top part includes first to fourth upper paperboards folded and extended from the upper portions of the first and second sidewall parts and the first and second connecting parts to form a handle, and a fifth upper paperboard folded from the third connecting part and disposed under the first to fourth upper paperboards to prevent withdrawal of contents from the receiving space.

19 Claims, 8 Drawing Sheets

(58) Field of Classification Search
USPC ..... 229/117.15, 117.14, 117.22, 157, 132, 229/185; 206/141, 169; 220/771
See application file for complete search history.

(56) References Cited

U.S. PATENT DOCUMENTS

| | | | | | |
|---|---|---|---|---|---|
| 4,308,995 | A | * | 1/1982 | Hanes | B65D 5/46096 206/141 |
| 4,318,470 | A | * | 3/1982 | Montealegre | B65D 5/3621 206/180 |
| 4,415,117 | A | * | 11/1983 | Pollard | B65D 5/46096 229/117.14 |
| 4,518,115 | A | * | 5/1985 | Sedwick | B65D 5/46088 206/141 |
| 5,584,430 | A | * | 12/1996 | Mulry | B65D 5/4608 229/117.13 |

FOREIGN PATENT DOCUMENTS

| | | |
|---|---|---|
| JP | 2015-34019 | 2/2015 |
| KR | 1998-060662 | 11/1998 |
| KR | 20-0267948 | 3/2002 |
| KR | 10-2007-0106350 | 11/2007 |
| KR | 10-0885978 | 3/2009 |
| KR | 10-2010-0012772 | 2/2010 |
| KR | 10-0965498 | 11/2011 |
| KR | 10-2014-0122618 | 10/2014 |

* cited by examiner

PACKING BOX

CROSS-REFERENCE TO RELATED APPLICATION(S)

This application claims priority under 35 USC § 119 to Korean Patent Applications No. 10-2015-0185916, filed on Dec. 24, 2015, and No. 10-2016-0088390, filed on Jul. 13, 2016 in the Korean Intellectual Property Office (KIPO), the contents of which are incorporated herein in its entirety by reference.

BACKGROUND

1. Technical Field

Example embodiments relate generally to a packing box. More particularly, the present invention uses a packing box capable of receiving an object therein.

2. Description of the Related Art

Packing boxes, generally, have low cost, and are easily manufactured, and have high efficiency compared with weight. Thus, the packing boxes are frequently used in packing contents including disposable coffee stick, beverage, and/or the like by a constant amount.

The packing boxes are completed as packing boxes configured to provide convenience of portability or transportation, and then, are deformed in a desired shape of users. Thus, the packing boxes include a structure in which a handle is prepared.

For the above-mentioned, in a conventional packing box, first, second, third, and fourth upper paperboards respectively disposed on upper portions of surfaces are sequentially folded and are glued in the folded state. Then, hanging holes are formed on both sides of the stacked upper paperboards, and a handle having synthetic resin and formed in a band shape is prepared and is combined by inserting both sides of the handle into the hanging holes.

However, the handle having the synthetic resin and formed in the band shape is prepared after manufacturing the packing boxes in an automation process, and then, the packing box is manually combined by inserting the both sides of the handle into the hanging holes by a worker. Thus, the manual process should be added, and the automation process is not possible.

Meanwhile, two handle pieces are formed on one upper paperboard, and the handle pieces are folded through punching holes of another upper paperboard formed on the upper paperboard, and are erected, thereby forming a handle. In this case, the handle pieces are spaced apart from each other on the upper paperboard to secure load-resistance. However, when the handle pieces are erected and form the handle, the handle pieces are partially spaced apart from each other, and thus, the handle has weak load-resistance.

SUMMARY

Some example embodiments provide a packing box having improved load-resistance and manufactured in an automation process.

According to some example embodiments, a packing box includes a first sidewall part, a second sidewall part, a first connecting part, a second connecting part, a third connecting part, a bottom part, and a top part. The first sidewall part and the second sidewall part are spaced apart from each other and facing each other. The first connecting part and the second connecting part are configured to connect both edges of the first and second sidewall parts. The first and second connecting parts are spaced apart from each other and facing each other. The third connecting part is extended from one of the second connecting part and the first sidewall part, and is configured to attach the second connecting part to the first sidewall part. The bottom part connects lower portions of the first and second sidewall parts and the first and second connecting parts. The top part faces the bottom part, and connects upper portions of the first and second sidewall parts and the first and second connecting parts to form a receiving space. The top part includes first to fourth upper paperboards folded and extended from the upper portions of the first and second sidewall parts and the first and second connecting parts to form a handle, and a fifth upper paperboard folded from the third connecting part and disposed under the first to fourth upper paperboards to prevent withdrawal of contents from the receiving space.

In example embodiments, a handle piece may be formed on a central portion of at least one among the first to fourth upper paperboards, and a punching hole may be formed on one among remaining of the first to fourth upper paperboards except the at least one upper paperboard on which the handle piece is formed such that the handle piece can be folded and erected through the punching hole.

Here, the first to fourth upper paperboards may include one of a first handle piece and a second handle piece prepared on a center thereof and a first punching hole and a second punching hole in which the first and second handle pieces are folded and erected.

In example embodiments, the first and second upper paperboards are folded and extended from the upper portions of the first and second sidewall parts, respectively, and include a first handle piece and a second handle piece rotated and folded in a first rotation direction to be a handle at a central portion thereof, and configured to recover an initial position by rotating in a second rotation direction opposite to the first rotation direction, respectively, and the third and fourth upper paperboards are folded and extended from the upper portions of the first and second connecting parts, respectively, and include a first punching hole and a second punching hole, and the third and fourth upper paperboards are disposed on the first and second upper paperboards, and the first and second punching holes are formed at positions correspond to the first and second handle pieces so that the first and second handle pieces are folded and erected or recover the initial position.

Here, when the first and second handle pieces are folded and erected in the same direction with respect to a central line of the top part as a rotation center, the first and second handle pieces may be prepared to be overlapped with each other to support weight during transportation of a user.

Also, the second handle piece may include a buffer part configured to be folded on an inner surface thereof to surround the first handle piece.

Meanwhile, the top part may further include a first cover part and a second cover part prepared to be folded in the first and second punching holes, and configured to be folded in an opposition direction and recover an initial position after the first and second handle pieces are rotated and erected.

In example embodiments, the top part may further include at least one glue member disposed between the first and fourth upper paperboards and preventing separation of the third and fourth upper paperboards.

Here, at least one glue area on a portion except the handle may be prepared on the third upper paperboard, and a perforated piece corresponding to the glue area may be formed on the fourth upper paperboard, and the glue member may be interposed between the perforated piece and the glue area.

Also, a plurality the glue areas may be formed to be spaced apart from each other opposite to the first punching hole with respect to a horizontal central line of the third upper paperboard.

Meanwhile, the glue area may be formed on a central portion opposite to the first punching hole with reference to a horizontal central line of the third upper paperboard.

In example embodiments, the fourth upper paperboard may include a protrusion portion protruded from a side surface of the second connecting part to easily separate the fourth upper paperboard from the third upper paperboard.

According to some example embodiments, a packing box includes a first sidewall part, a second sidewall part, a first connecting part, a second connecting part, a bottom part, and a top part. The first sidewall part and the second sidewall part are spaced apart from each other and facing each other. The first connecting part and the second connecting part are configured to connect both edges of the first and second sidewall parts. The first and second connecting parts are spaced apart from each other and facing each other. The bottom part connects lower portions of the first and second sidewall parts and the first and second connecting parts. The top part faces the bottom part, and connects upper portions of the first and second sidewall parts and the first and second connecting parts to form a receiving space.

The top part includes a first upper paperboard, a second upper paperboard, a third upper paperboard, and a fourth upper paperboard. The first upper paperboard and the second upper paperboard are respectively folded and extended from the upper portions of the first and second sidewall parts. The first and second upper paperboards include a first handle piece and a second handle piece folded on a center thereof to be used as a handle. The third upper paperboard and the fourth upper paperboard are respectively folded and extended from the upper portions of the first and second connecting parts, and are overlapped with the first and second upper paperboards. A first punching hole and a second punching hole are formed through the third and fourth upper paperboards so that the first and second handle pieces are folded and erected.

In example embodiments, when the first and second handle pieces are folded and erected with respect to a central line of the top part as a rotation center, the first and second handle pieces may be prepared to be overlapped with each other to support weight during transportation of a user.

In example embodiments, the packing box may further include a glue part configured to attach the second connecting part to the first sidewall part, and a third connecting part horizontally extended from an upper portion of the glue part. The top part may further include a fifth upper paperboard folded from the third connecting part to prevent withdrawal of contents from the receiving space.

In example embodiments, the top part may further include at least one glue member disposed between the third and fourth upper paperboards and preventing separation of the third upper paperboard from the fourth upper paperboard.

Here, at least one glue area may be prepared on a portion except a first punching hole of the third upper paperboard, and a perforated piece corresponding to the glue area may be formed on the fourth upper paperboard, and the glue member may be interposed between the perforated piece and the glue area.

In example embodiments, the fourth upper paperboard may include a protrusion portion protruded from a side surface of the second connecting part to easily separate the fourth upper paperboard from the third upper paperboard.

In example embodiments, the second handle piece may include a buffer part configured to be folded on an inner surface thereof to surround the first handle piece.

In example embodiments, the top part may further include a first cover part and a second cover part prepared to be folded in the first and second punching holes, and configured to be folded in an opposition direction and recover an initial position after the first and second handle pieces are rotated and erected.

According to the embodiments of the present invention, the packing box includes a top part including first and second side parts and first to fourth upper paperboards foldably extended from first and second extended parts. In this case, first and second handle pieces are prepared in the first and second upper paperboards, respectively, and first and second punching holes are prepared in the third and fourth upper paperboards. Thus, when the first and second handle pieces are folded through the first and second punching holes and erected, a handle is formed, and thus, load-resistance supported by the handle is improved, and the packing box may be easily formed through an automation process.

BRIEF DESCRIPTION OF THE DRAWINGS

Illustrative, non-limiting example embodiments will be more clearly understood from the following detailed description taken in conjunction with the accompanying drawings.

DETAILED DESCRIPTION OF THE EMBODIMENTS

Figure 1:
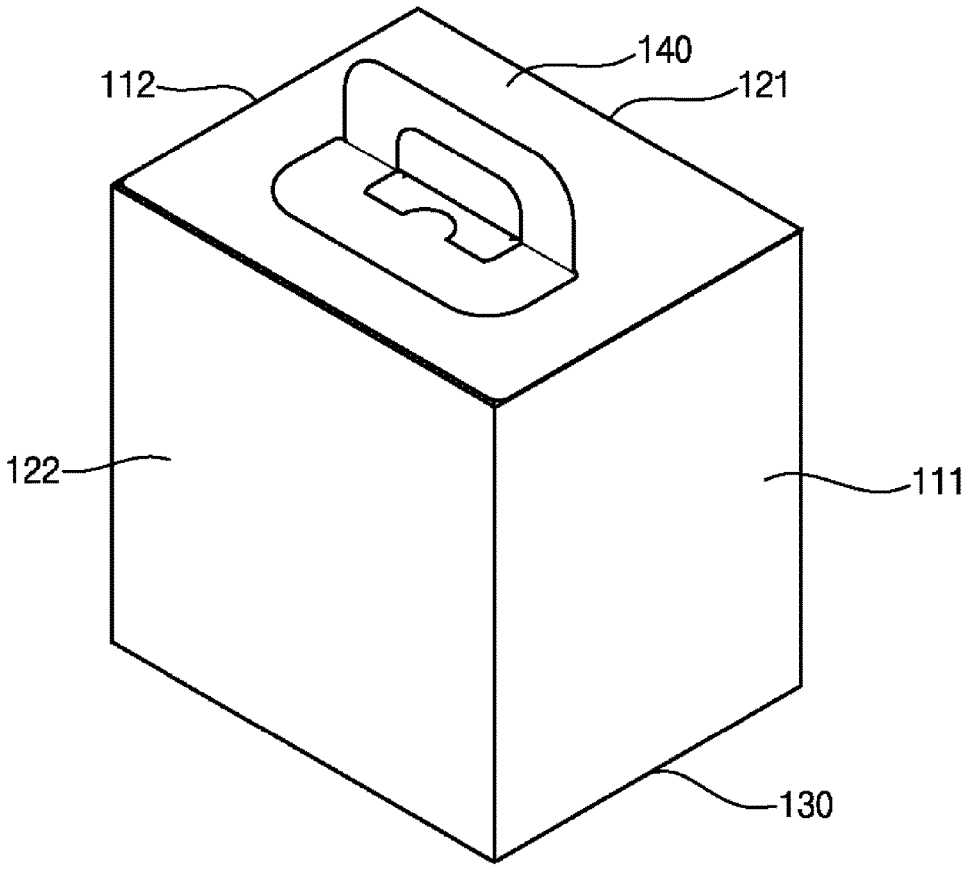
FIG. 1 is a perspective view illustrating a packing box according to one embodiment of the present invention.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, etc. may be used herein to describe various elements, these elements should not be limited by these terms. These terms are used to distinguish one element from another. For example, a first element discussed below could be termed a second element without departing from the teachings of the present inventive concept. Also, a second element discussed below could be termed a first element without departing from the teachings of the present inventive concept. As used herein, the singular forms are intended to include the plural forms as well, unless the context clearly indicates otherwise.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.). It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

Meanwhile, the terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
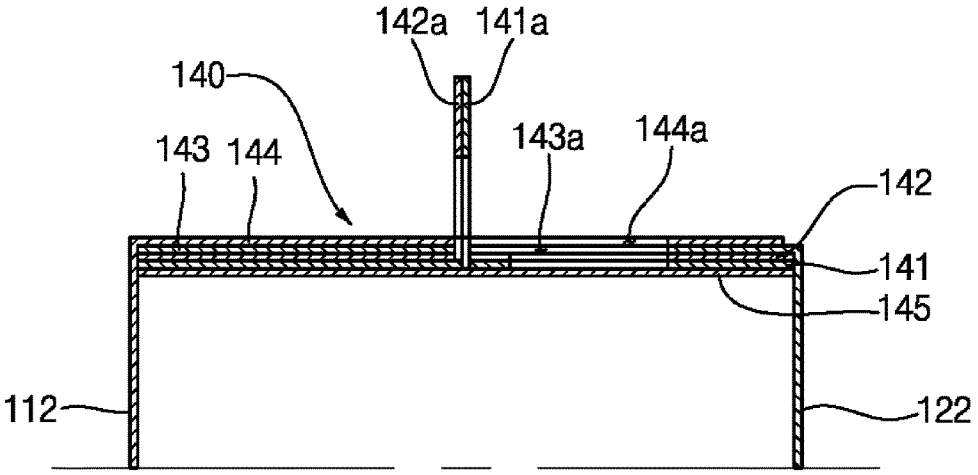
FIG. 2 is a cross-sectional view illustrating a top part of the packing box of FIG. 1.
Figure 3:
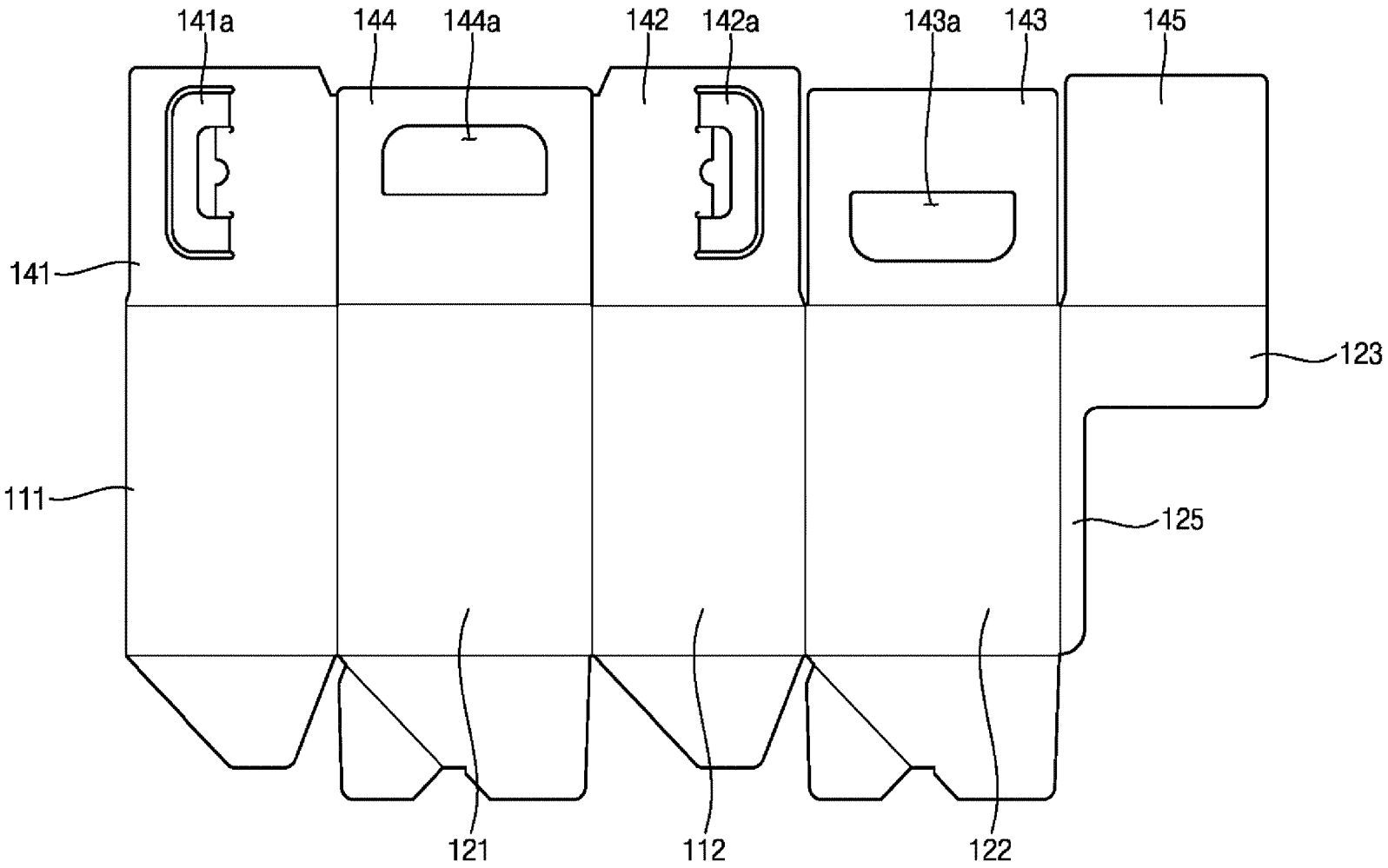
FIG. 3 is a development view illustrating the packing box of FIG. 1.

FIG. 1 is a perspective view illustrating a packing box according to one embodiment of the present invention. FIG. 2 is a cross-sectional view illustrating a top part of the packing box of FIG. 1. FIG. 3 is a development view illustrating the packing box of FIG. 1.

Referring to FIGS. 1 to 3, the packing box according to the embodiment of the present invention includes a first sidewall part 111, a second sidewall part 112, a first connecting part 121, a second connecting part 122, a bottom part 130, and a top part 140. A receiving space is defined by the first and second sidewall parts 111 and 112, the first and second connecting parts 121 and 122, the bottom part 130, and the top part 140. The packing box may have a hexagonal shape. The packing box may include a plurality of paperboards including paper.

The first sidewall part 111 is prepared to face the second sidewall part 112. The first and second sidewall parts 111 and 112 are spaced apart from each other. The first and second sidewall parts 111 and 112 maintain erection state in a vertical direction.

The first connecting part 121 and the second connecting part 122 connects both vertical edges of the first and second sidewall parts 111 and 112. The first connecting part 121 is prepared to face the second connecting part 122. The first connecting part 121 and the second connecting part 122 are prepared to be spaced apart from each other.

Thus, the first connecting part 121 and the second connecting part 122 define a frontal surface and a rear surface of the packing box, respectively. The first connecting part 121 and the second connecting part 122 also maintain erection state in the vertical direction.

The bottom part 130 connects lower portions of the first and second sidewall parts 111 and 112 and the first and second connecting parts 121 and 122. Thus, the bottom part 130 defines a lower surface of the packing box.

The bottom part 130 includes a plurality of bottom pieces extended to be folded from the first and second sidewall parts 111 and 112 and the first and second connecting parts 121 and 122. Thus, the bottom pieces may be assembled to form the bottom part 130.

The top part 140 is prepared to face the bottom part 130. The top part 140 connects the first and second sidewall parts 111 and 112 and the first and second connecting parts 121 and 122. The top part 140 forms the receiving space with the first and second sidewall parts 111 and 112 and the first and second connecting parts 121 and 122. Thus, the packing box having the receiving space is formed.

The top part 140 includes first to fourth upper paperboards 141, 142, 143, and 144.

The first upper paperboard 141 is extended from an upper portion of the first sidewall part 111. The first upper paperboard 141 may be folded on the upper portion of the first sidewall part 111. The first upper paperboard 141 includes a first handle piece 141*a* which may be folded on a central portion thereof to be used as a handle.

The first handle piece 141*a* may be formed by incising a central portion of the first upper paperboard 141. The first handle piece 141*a* is formed by incising different C-shaped lines with respect to a center of the first upper paperboard 141 as concentric circles. Thus, the first handle piece 141*a* may have a C-shape. Also, a first finger groove may be additionally formed on the first finger piece 141*a*, so that a finger of a user may be inserted thereinto. Thus, the finger of the user is inserted into the first finger groove, so that the first finger piece 141*a* may be rotated and erected.

The second upper paperboard 142 is extended from an upper portion of the second sidewall part 112. The second upper paperboard 142 may be folded on the upper portion of the second sidewall part 112. The second upper paperboard 142 includes a second handle piece 142*a* which may be folded on a central portion thereof to be used as a handle. The second handle piece 142*a* has the same shape and size with respect to the first handle piece 141*a* to be completely overlapped with each other.

The second handle piece 142*a* may be formed by incising on a central portion of the second upper paperboard 142. The second handle piece 142*a* is formed by incising different C-shaped lines with respect to a center of the second upper paperboard 142 as concentric circles. Thus, the second handle piece 141*a* may a C-shape. Also, a second finger groove may be additionally formed on the second finger piece 142*a*, so that a finger of a user may be inserted thereinto. Thus, the finger of the user is inserted into the second finger groove, so that the second finger piece 142*a* may be rotated and erected. Therefore, the first and second handle pieces 141*a* and 142*a* may be simultaneously rotated and erected using the first and second finger grooves. Thus, the handle including the first and second handle pieces 141*a* and 142*a* may be formed.

The third upper paperboard 143 is folded and extended from the upper portion of the second connecting part 122. The third upper paperboard 143 is disposed to be overlapped on the second upper paperboard 142. A first punching hole 143*a* is formed through the third upper paperboard 143, so that the first and second handle pieces 141*a* and 142*a* are folded and erected. That is, the first punching hole 143*a* provides a space in which the first and second handle pieces 141*a* and 142*a* are folded and erected.

The first punching hole 143*a* is formed, so that a central portion of the third upper paperboard 143 is bent, and thus, the first and second handle pieces 141*a* and 142*a* may be erected.

The fourth upper paperboard 144 is folded and extended from the upper portion of the first connecting part 121. The fourth upper paperboard 144 is disposed to be overlapped on the third upper paperboard 143. A second punching hole 144*a* is formed through the fourth upper paperboard 144, so that the first and second handle pieces 141*a* and 142*a* are folded and erected. The second punching hole 144*a* is formed to have substantially the same size and shape as the first punching hole 143*a*.

Thus, the first and second punching holes 143*a* and 144*a* provide a space in which the first and second handle pieces 141*a* and 142*a* are folded and erected.

The second punching hole 144*a* is formed, so that a central portion of the fourth upper paperboard 144 is bent, and thus, the first and second handle pieces 141*a* and 142*a* may be erected.

According to the embodiments of the present invention, the top part 140 includes the first to fourth upper paperboards 141, 142, 143, and 144 respectively extended from the first and second sidewall parts 111 and 112 and the first and second connecting parts 121 and 122. Thus, the top part 140 may form a handle part using the four upper paperboards 141, 142, 143, and 144 as a whole. Thus, compared with a case of forming a handle part using two or three upper paperboards in a top part, the top part 140 uniformly dissipates and supports weight of an object towards four surfaces, and thus, load-resistance is improved.

When the first and second handle pieces 141*a* and 142*a* respectively formed on the first and second upper paperboards 141 and 142 are folded and erected, the first and second handle pieces 141*a* and 142*a* pass through the first and second punching holes 143*a* and 144*a* respectively formed through the third and fourth upper paperboards 143 and 144, thereby forming the handle. Here, when the first and second handle pieces 141*a* and 142*a* are folded and erected, the first and second handle pieces 141*a* and 142*a* are rotated in the same rotation direction. Thus, the first and second handle pieces 141*a* and 142*a* are contacted with each other and rotate, and thus, the handle including the first and second handle pieces 141*a* and 142*a* may be more secured. Also, the two handle pieces 141*a* and 142*a* are simultaneously folded in the same rotation direction, thereby forming the handle.

When the first and second handle pieces 141*a* and 142*a* rotate in different rotation directions to form a handle, the first and second handle pieces may be partially separated. In this case, the handle including the first and second handle pieces may have relatively weak load-resistance. Two handle pieces are respectively folded in the different rotation directions, and thus, the handle may be formed in an inconvenient method.

Also, the first and second handle pieces 141*a* and 142*a* respectively formed on the first and second upper paperboards 141 and 142 rotate with respect to a central line in a lengthwise direction of the top part 140 to form the handle. Compared with a case in which a handle is formed by rotating the first and second handle pieces 141*a* and 142*a* with respect to a central line in a shortwise direction, the handle may have greater length. Thus, the handle may have more secure load-resistance.

According to the embodiment of the present invention, the first to fourth upper paperboards 141, 142, 143, and 144 may have substantially the same outer size as the top part 140. Thus, the first to fourth upper paperboards 141, 142, 143, and 144 are prepared to be entirely overlapped, thereby forming the top part 140. As a result, the top part 140 may have more secure structure.

Also, the first and second handle pieces 141*a* and 142*a* and the first and second punching holes 143*a* and 144*a* respectively formed on the first to fourth upper paperboards 141, 142, 143, and 144 may have relatively greater size, and thus, the handle including the first and second handle pieces 141*a* and 142*a* passing through the first and second punching holes 143*a* and 144*a* may have secure load-resistance.

According to the embodiment of the present invention, the first and second connecting parts 121 and 122 may have greater width than the first and second sidewall parts 111 and 112. Thus, the first and second punching holes 143*a* and 144*a* formed through the third upper paperboard 143 and the fourth upper paperboard 144 respectively extended from the first and second connecting parts 121 and 122 may be formed to have relatively greater width. As a result, the handle formed by passing through the first and second punching holes 143*a* and 144*a* and erected may have more secure structure.

According to one embodiment of the present invention, the top part 140 may further include a fifth upper paperboard 145 configured to prevent withdrawal of contents from the receiving space. Thus, the first and second upper paperboards 141 and 142 extended from the first and second sidewall parts 111 and 112 and the third and fourth upper paperboards 143 and 144 extended from the first and second connecting parts 121 and 122 may be used to form the handle part.

That is, when one of the first to fourth upper paperboards 141, 142, 143, and 144, which include the first and second upper paperboards 141 and 142 extended from the first and second sidewall parts 111 and 112 and the third and fourth upper paperboards 143 and 144 extended from the first and second connecting parts 121 and 122, is used as a withdrawal preventing part, only remaining three upper paperboards may be used to form the handle. In this case, load-resistance of the handle may be decreased.

However, in the embodiment of the present invention, the handle part is formed using the first to fourth upper paperboards 141, 142, 143, and 144. Meanwhile, the packing box further include a glue part 125 extended from the second connecting part 122 to prepare a space in which the second connecting part is attached to the first sidewall part and a third connecting part 123 horizontally extended from an upper portion of the glue part 125.

Here, the fifth upper paperboard 145 is extended to be folded from the third connecting part 123. The fifth upper paperboard 145 may prevent withdrawal of the contents from the receiving space.

Figure 4A:
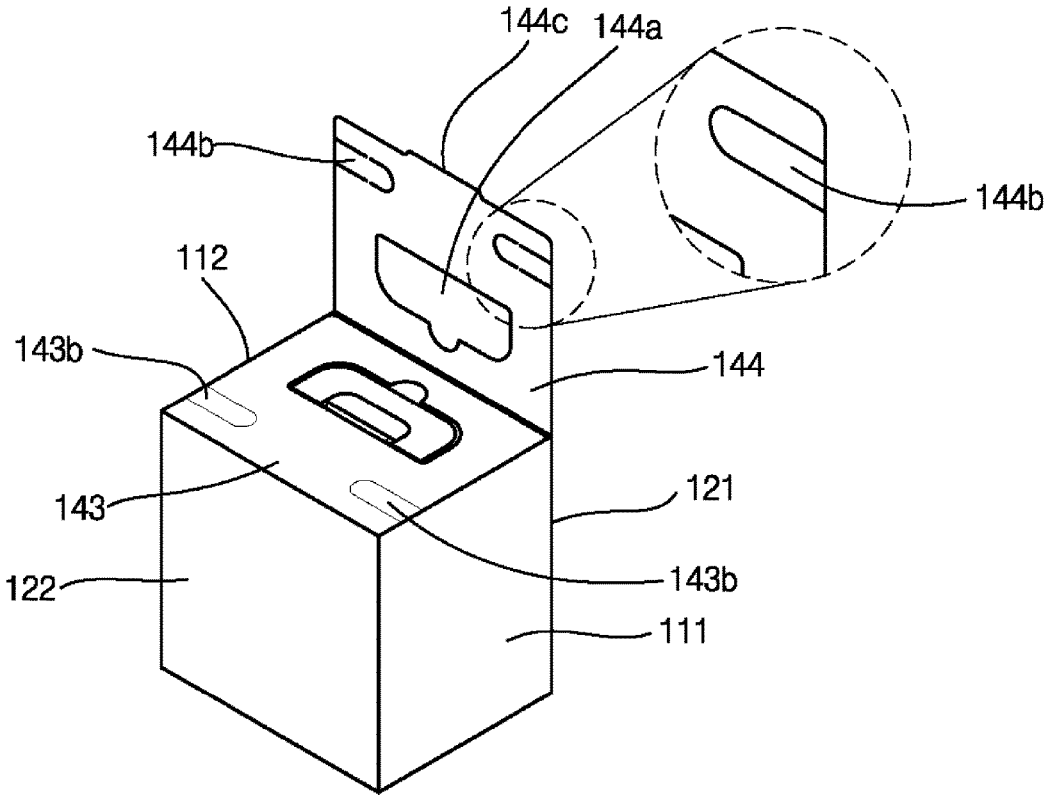
FIGS. 4A and 4B are perspective views illustrating opening process of a fourth upper paperboard among a packing box according to one embodiment of the present invention.
Figure 4B:
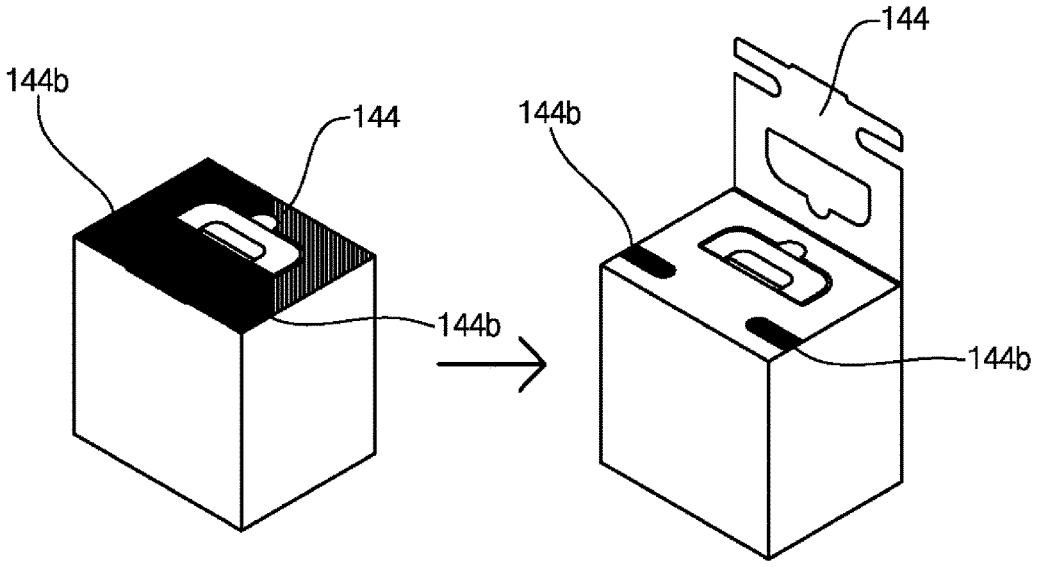

FIGS. 4A and 4B are perspective views illustrating opening process of a fourth upper paperboard among a packing box according to one embodiment of the present invention.

Referring to FIGS. 4A and 4B, the packing box according to the embodiment of the present invention includes a first sidewall part 111, a second sidewall part 112, a first connecting part 121, a second connecting part 122, a bottom part 130, and a top part 140. A receiving space is defined by the first and second sidewall parts 111 and 112, the first and second connecting parts 121 and 122, the bottom part 130, and the top part 140. The packing box may have a hexagonal shape. The packing box may include a plurality of paperboards including paper.

The top part 140 may further include at least one glue members 143*b* disposed between the third and fourth upper paperboards. The glue member 143*b* may prevent separation of the third and fourth upper paperboards 143 and 144. Thus, when the packing box is transported using the handle, the glue member prevents the separation of the third and fourth upper paperboards. Therefore, when the packing box is transported by gripping the handle, load-resistance supported by the handle may be improved. Examples of the glue member may include adhesives, adhesive tape, etc.

Glue areas in which adhesives are coated are defined on the third upper paperboard except a first punching part, and perforated pieces corresponding to the glue areas are formed on the fourth upper paperboard, and the glue member may be interposed between the perforated pieces and the glue areas.

The perforated pieces on the fourth upper paperboard 144 are bent along a dotted line and maintain a semi-perforated state, and when a user lifts up a fourth upper paperboard to open, the perforated pieces are naturally separated from the fourth upper paperboard 144 and attached to the third upper paperboard 143. Thus, the fourth upper paperboard 144 may be easily separated from the third upper paperboard 143, and neatly separated with beauty.

Here, the glue area of the adhesives of the third upper paperboard 143 and the perforated pieces on the fourth upper paperboard 144 may be formed in various sizes and shapes.

According to the embodiment of the present invention, glue areas (not shown) separated from each other in an opposite direction to the first punching hole 143*a* with respect to a longitudinal central line of the third upper paperboard 143 may be respectively prepared. Meanwhile, perforated pieces 144*b* may be formed on the fourth upper paperboard 144 to correspond to the glue areas, respectively. In this case, the glue member 143*b* is interposed between the glue areas and the perforated pieces 144*b*. Therefore, a user may separate a portion of the fourth upper paperboard 144 on which the glue member is not formed from the third upper paperboard 143, and thus, the fourth upper paperboard 144 may be easily separated from the third upper paperboard 143. That is, when the user separates the fourth upper paperboard 144 from the third upper paperboard, the perforated piece 144*b* is separated from the fourth upper paperboard 144, and thus, the fourth upper paperboard 144 may be easily separated from the third upper paperboard 143, and neatly separated with beauty.

Here, the perforated pieces 144*b* may maintain attachment state to the third upper paperboard 143 by the glue member 143*b*.

Meanwhile, the fourth upper paperboard 144 may further include a protrusion portion protruded from a sidewall of the second connecting part 122. Thus, the protrusion portion 144*c* may be gripped, and thus, the fourth upper paperboard 144 may be easily separated from the third upper paperboard 143.

Figure 5A:
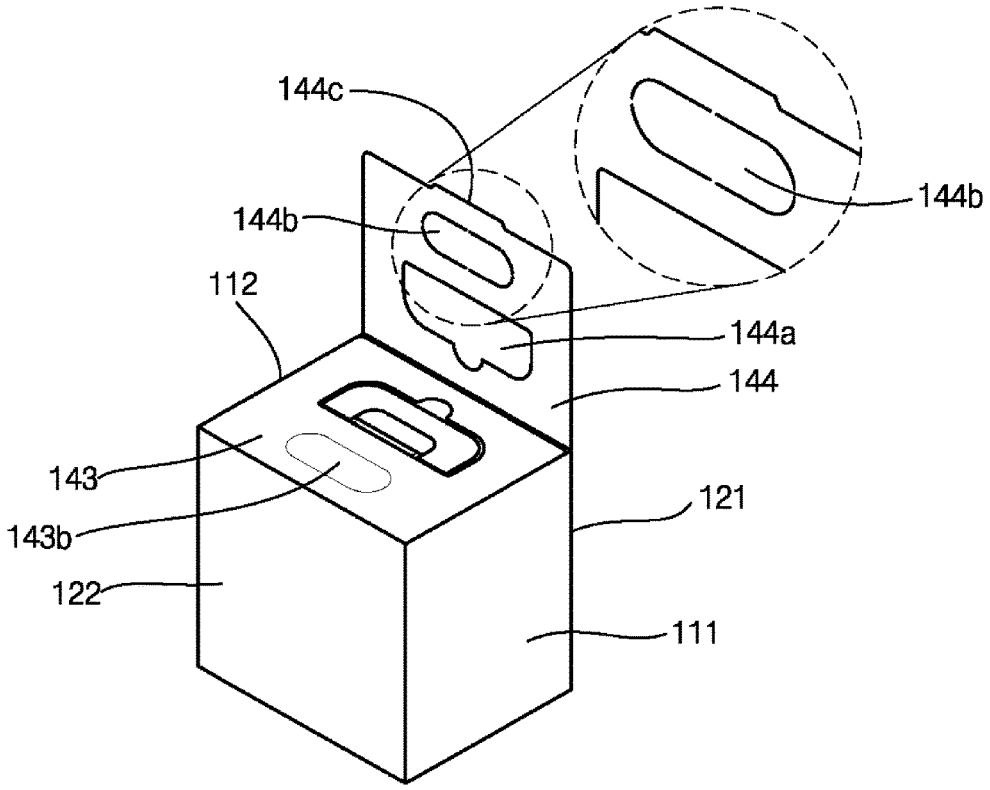
FIGS. 5A and 5B are perspective views illustrating opening process of a fourth upper paperboard among the a packing box according to one embodiment of the present invention.
Figure 5B:
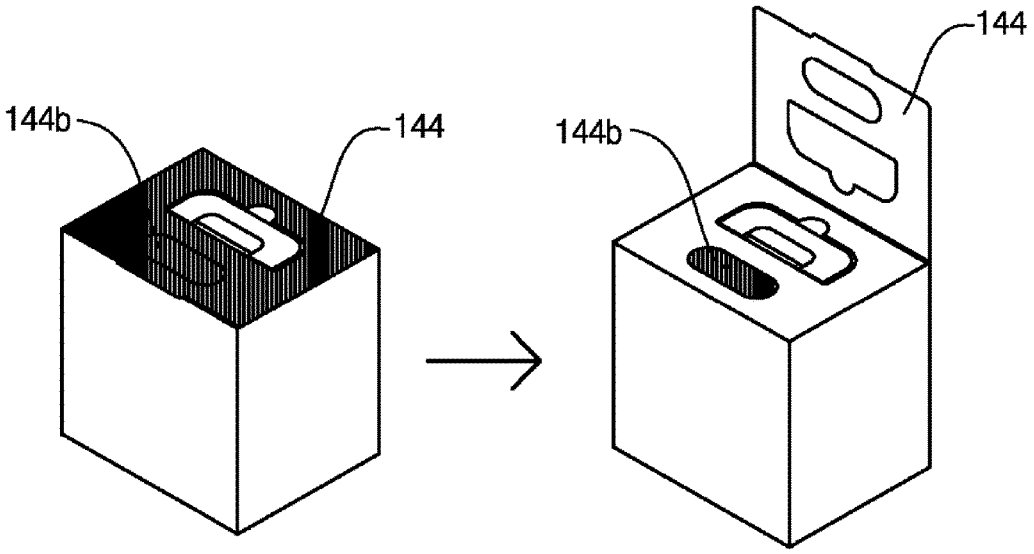

FIGS. 5A and 5B are perspective views illustrating opening process of a fourth upper paperboard among the a packing box according to one embodiment of the present invention.

Referring to FIGS. 5A and 5B, the packing box according to the embodiment of the present invention is the same as the packing box explained with reference to FIGS. 4A and 4B except position of a glue members 143*b*.

Also, a glue area may be prepared on a central portion opposite to a first punching hole 143*a* with reference to a longitudinal central line of a third upper paperboard 143. Meanwhile, a perforated piece 144*b* may be formed on the fourth upper paperboard to correspond to the glue area. In this case, the glue member 143*b* is interposed between the glue area and the perforated piece 144*b*. Therefore, a user may separate a portion on which the glue member is not formed from the third upper paperboard, and thus, the fourth upper paperboard 144 may be easily separated from the third upper paperboard 143. Here, the perforated piece 144*b* may remain on the third upper paperboard 143 by the glue member 143*b*.

Figure 6A:
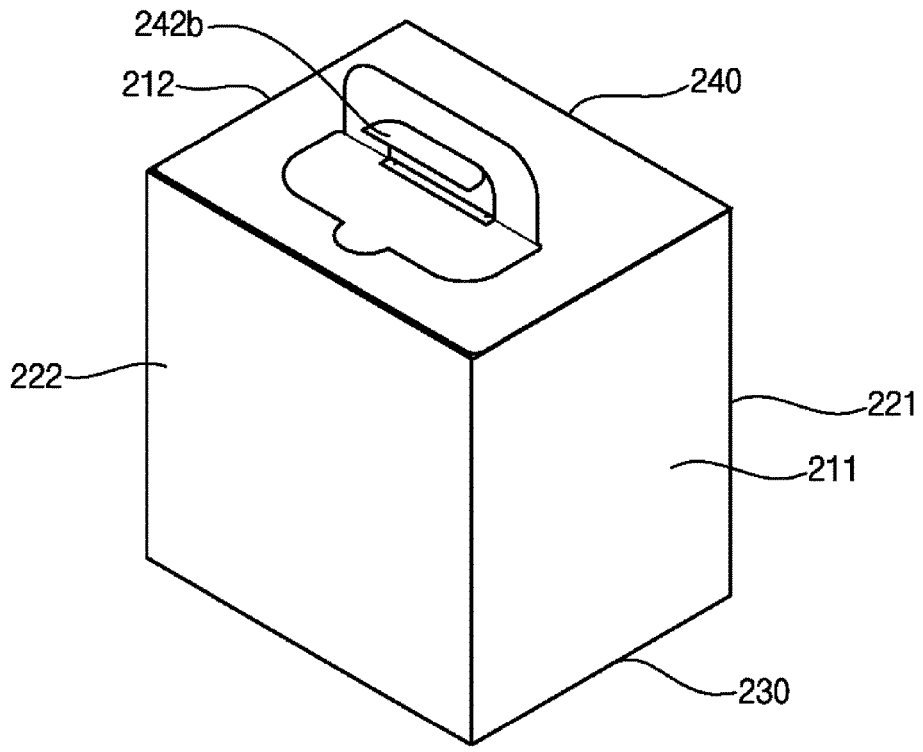
FIG. 6A is a perspective view illustrating a packing box according to one embodiment of the present invention.
Figure 6B:
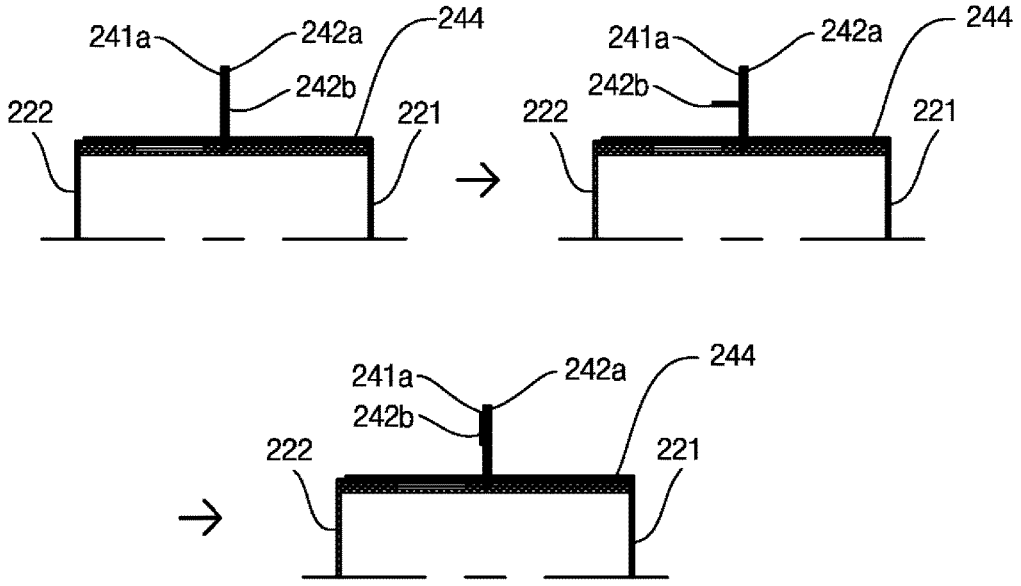
FIG. 6B is a cross-sectional view illustrating a top part of FIG. 6A.
Figure 7:
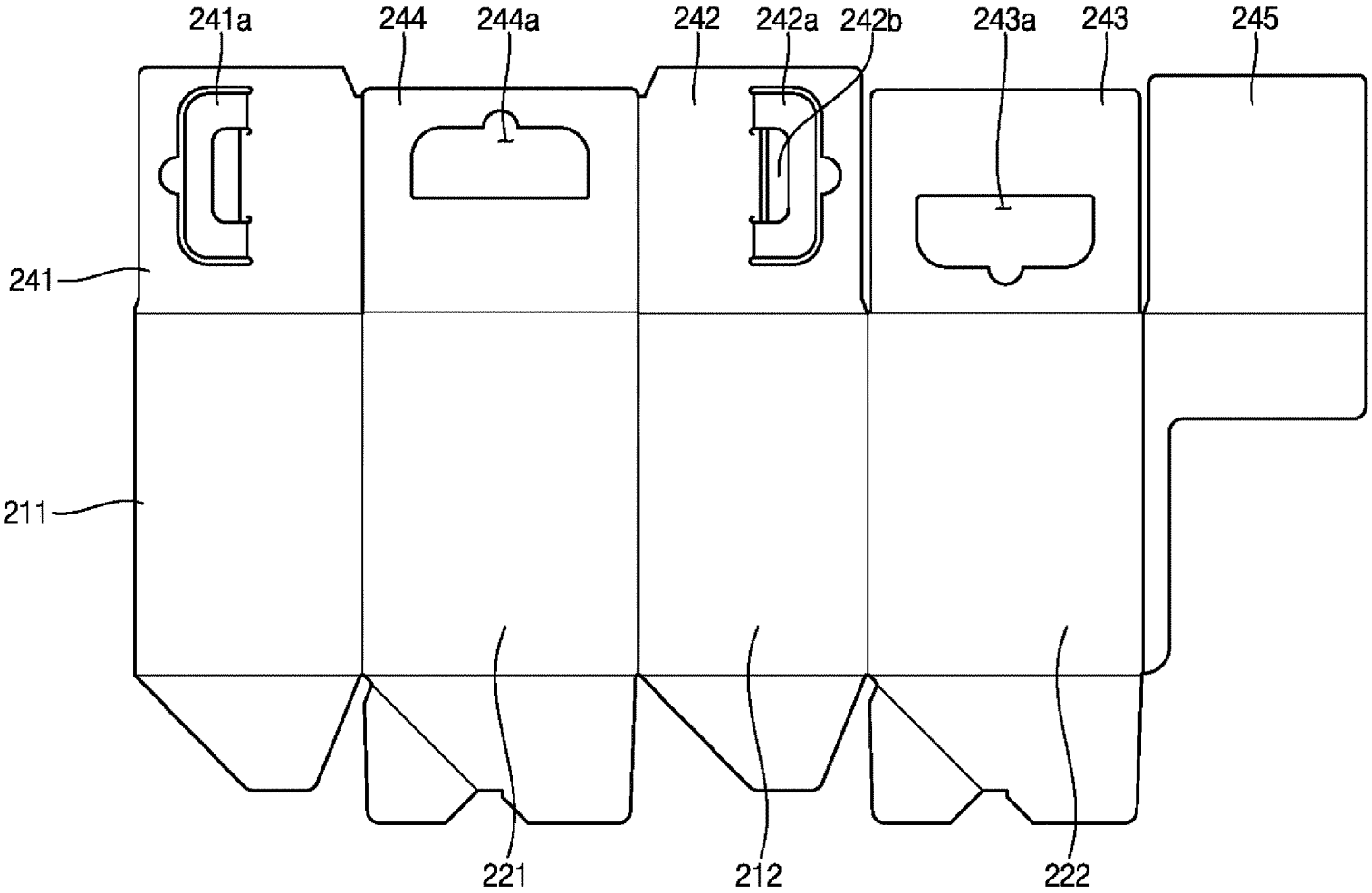
FIG. 7 is a development view illustrating a packing box of FIG. 6A.

FIG. 6A is a perspective view illustrating a packing box according to one embodiment of the present invention. FIG. 6B is a cross-sectional view illustrating a top part of FIG. 6A. FIG. 7 is a development view illustrating a packing box of FIG. 6A.

Referring to FIGS. 6A, 6B, and 7, the packing box according to the embodiment of the present invention includes a first sidewall part 211, a second sidewall part 212, a first connecting part 221, a second connecting part 222, a bottom part 230, and a top part 240. A receiving space is defined by the first and second sidewall parts 211 and 212, the first and second connecting parts 221 and 222, the bottom part 230, and the top part 240. The packing box may have a hexagonal shape. The packing box may include a plurality of paperboards.

A second handle piece 242*a* is formed on the second upper paperboard 242 extended from the second sidewall part 212. A buffer portion 242*b* which is bent to surround a first handle piece 241*a* may be prepared on an inner surface of the second handle piece 242*a*. Thus, when the user grips the handle, the buffer portion 242*b* is prepared to surround the first handle piece 241*a*, so that the user may grip the handle more softly, and thus, an impact generated by a hand of the user may be relieved.

Figure 8:
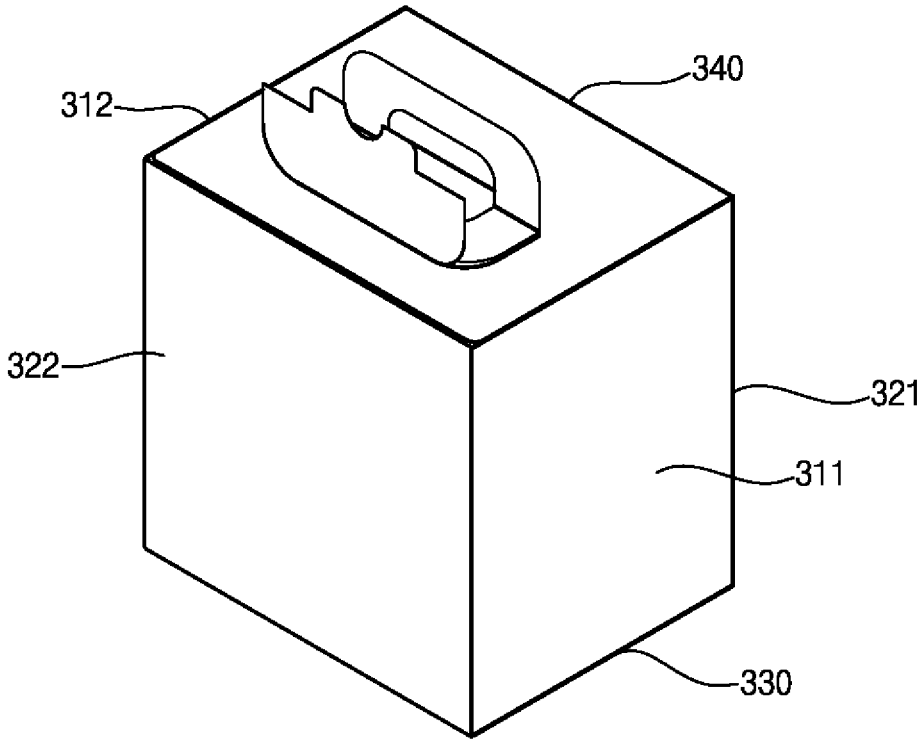
FIG. 8 is a perspective view illustrating a packing box according to one embodiment of the present invention.
Figure 9:
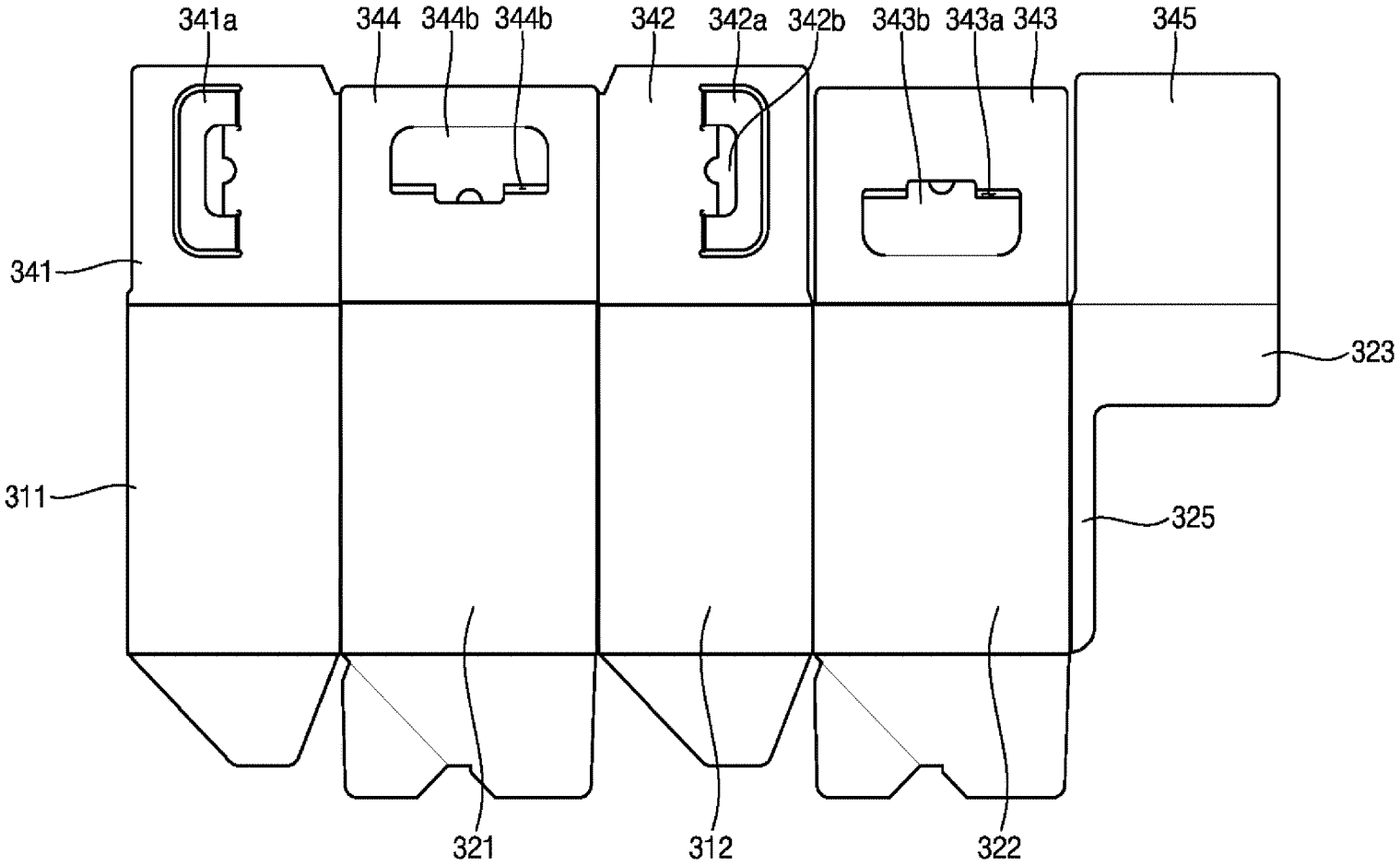
FIG. 9 is a development view illustrating the packing box of FIG. 8.

FIG. 8 is a perspective view illustrating a packing box according to one embodiment of the present invention. FIG. 9 is a development view illustrating the packing box of FIG. 8.

Referring to FIGS. 8 and 9, a top part 340 is prepared to be folded into the first and second punching holes 343*a* and 344*a*, and may further include a first cover part 343*b* and a second cover part 344*b* configured to recover an initial position of first and second handle pieces 341*a* and 342*a* after being folded in an opposite direction in case of erection of the first and second handle pieces 341*a* and 342*a*. Thus, when the handle is formed, the first and second punching holes 343*a* and 344*a* may be more efficiently closed using the first and second cover parts 343*b* and 344*b*.

According to the embodiments of the present invention, the packing box may be used in receiving and transporting a taste tea bag or beverage such as disposable coffee mix.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A packing box, comprising:

a first sidewall part and a second sidewall part spaced apart from each other and facing each other;

a first connecting part and a second connecting part configured to connect both edges of the first and second sidewall parts, the first and second connecting parts being spaced apart from each other and facing each other;

a third connecting part extended from one of the second connecting part and the first sidewall part, and configured to attach the second connecting part to the first sidewall part;

a bottom part connecting lower portions of the first and second sidewall parts and the first and second connecting parts; and a top part facing the bottom part, and connecting upper portions of the first and second sidewall parts and the first and second connecting parts to form a receiving space, wherein the top part includes:

first to fourth upper paperboards folded and extended from the upper portions of the first and second sidewall parts and the first and second connecting parts to form a handle; and a fifth upper paperboard folded from the third connecting part and disposed under the first to fourth upper paperboards to prevent withdrawal of contents from the receiving space, wherein the first to fifth upper paperboards have substantially the same outer sizes, and the first to fourth upper paperboards include one of a first handle piece and a second handle piece prepared on a center portion entirely enclosed by a peripheral portion thereof, and a first punching hole and a second punching hole in which the first and second handle pieces are folded and erected, respectively.

2. The packing box of claim 1, wherein a handle piece is formed on a central portion of at least one among the first to fourth upper paperboards, and a punching hole is formed on one among remaining of the first to fourth upper paperboards except the at least one upper paperboard on which the handle piece is formed such that the handle piece can be folded and erected through the punching hole.

3. The packing box of claim 1, wherein the first and second upper paperboards are folded and extended from the upper portions of the first and second sidewall parts, respectively, and include a first handle piece and a second handle piece rotated and folded in a first rotation direction to be a handle at a central portion thereof, and configured to recover an initial position by rotating in a second rotation direction opposite to the first rotation direction, respectively, and the third and fourth upper paperboards are folded and extended from the upper portions of the first and second connecting parts, respectively, and include a first punching hole and a second punching hole, and the third and fourth upper paperboards are disposed on the first and second upper paperboards, and the first and second punching holes are formed at positions correspond to the first and second handle pieces so that the first and second handle pieces are folded and erected or recover the initial position.

4. The packing box of claim 3, wherein when the first and second handle pieces are folded and erected in the same direction with respect to a central line of the top part as a rotation center, the first and second handle pieces are prepared to be overlapped with each other to support weight during transportation of a user.

5. The packing box of claim 3, wherein the second handle piece includes a buffer part configured to be folded on an inner surface thereof to surround the first handle piece.

6. The packing box of claim 3, wherein the top part further comprises a first cover part and a second cover part prepared to be folded in the first and second punching holes, and configured to be folded in an opposition direction and recover an initial position after the first and second handle pieces are rotated and erected.

7. The packing box of claim 1, wherein the top part further comprises at least one glue member disposed between the first and fourth upper paperboards and preventing separation of the third and fourth upper paperboards.

8. The packing box of claim 7, wherein at least one glue area on a portion except the handle is prepared on the third upper paperboard, and a perforated piece corresponding to the glue area is formed on the fourth upper paperboard, and the glue member is interposed between the perforated piece and the glue area.

9. The packing box of claim 8, wherein a plurality the glue areas are formed to be spaced apart from each other opposite to the first punching hole with respect to a horizontal central line of the third upper paperboard.

10. The packing box of claim 8, wherein the glue area is formed on a central portion opposite to the first punching hole with reference to a horizontal central line of the third upper paperboard.

11. The packing box of claim 1, wherein the fourth upper paperboard comprises a protrusion portion protruded from a side surface of the second connecting part to easily separate the fourth upper paperboard from the third upper paperboard.

12. The packing box of claim 1, wherein the top part further comprises at least one glue member disposed between the third and fourth upper paperboards and preventing separation of the third upper paperboard from the fourth upper paperboard.

13. The packing box of claim 12, wherein at least one glue area is prepared on a portion except a first punching hole of the third upper paperboard, and a perforated piece corresponding to the glue area is formed on the fourth upper paperboard, and the glue member is interposed between the perforated piece and the glue area.

14. A packing box, comprising:

a first sidewall part and a second sidewall part spaced apart from each other and facing each other;

a first connecting part and a second connecting part configured to connect both edges of the first and second sidewall parts, the first and second connecting parts being spaced apart from each other and facing each other;

a bottom part connecting lower portions of the first and second sidewall parts and the first and second connecting parts; and a top part facing the bottom part, and connecting upper portions of the first and second sidewall parts and the first and second connecting parts to form a receiving space, wherein the top part includes:

a first upper paperboard and a second upper paperboard respectively folded and extended from the upper portions of the first and second sidewall parts, the first and second upper paperboards including a first handle piece and a second handle piece folded on a center portion entirely enclosed by a peripheral portion thereof to be used as a handle, respectively; and a third upper paperboard and a fourth upper paperboard respectively folded and extended from the upper portions of the first and second connecting parts, and overlapped with the first and second upper paperboards, a first punching hole and a second punching hole being formed through the third and fourth upper paperboards so that the first and second handle pieces are folded and erected, wherein the first to fourth upper paperboards have substantially the same outer sizes.

15. The packing box of claim 14, wherein when the first and second handle pieces are folded and erected with respect to a central line of the top part as a rotation center, the first and second handle pieces are prepared to be overlapped with each other to support weight during transportation of a user.

16. The packing box of claim 14, further comprising:

a glue part configured to attach the second connecting part to the first sidewall part; and a third connecting part horizontally extended from an upper portion of the glue part, and wherein the top part further comprises a fifth upper paperboard folded from the third connecting part to prevent withdrawal of contents from the receiving space.

17. The packing box of claim 14, wherein the fourth upper paperboard comprises a protrusion portion protruded from a side surface of the second connecting part to easily separate the fourth upper paperboard from the third upper paperboard.

18. The packing box of claim 14, wherein the second handle piece includes a buffer part configured to be folded on an inner surface thereof to surround the first handle piece.

19. The packing box of claim 14, wherein the top part further comprises a first cover part and a second cover part prepared to be folded in the first and second punching holes, and configured to be folded in an opposition direction and recover an initial position after the first and second handle pieces are rotated and erected.

* * * * *